US005334820A

United States Patent [19]

Risch et al.

[11] Patent Number: 5,334,820

[45] Date of Patent: Aug. 2, 1994

[54] MICROWAVE FOOD HEATING PACKAGE WITH ACCORDION PLEATS

[75] Inventors: Sara J. Risch; Lawrence C. Brandberg, both of Edina, Minn.

[73] Assignee: Golden Valley Microwave Foods Inc., Edina, Minn.

[21] Appl. No.: 843,524

[22] Filed: Feb. 28, 1992

[51] Int. Cl.[5] ..... H05B 6/80

[52] U.S. Cl. ..... 219/730; 219/732; 426/107; 426/234; 426/243; 99/DIG. 14

[58] Field of Search ..... 219/10.55 E, 10.55 F; 426/107, 109, 110, 111, 113, 114, 234, 241, 243; 99/DIG. 14, 451; 229/903, 906

[56] References Cited

U.S. PATENT DOCUMENTS

| | | | |
|---|---|---|---|
| 2,830,162 | 4/1958 | Copson et al. | 219/10.41 |
| 2,917,218 | 12/1959 | Guyer | 229/23 |
| 3,027,062 | 3/1962 | Huss | 229/23 |
| 3,271,169 | 9/1966 | Baker et al. | 99/221 |
| 3,302,632 | 2/1967 | Fichtner | 126/390 |
| 3,353,968 | 11/1967 | Krajewski | 99/192 |
| 3,411,696 | 11/1968 | Ayer | 229/40 |
| 3,483,358 | 12/1969 | Eisler | 219/385 |
| 3,943,320 | 3/1976 | Bowen | 219/10.55 E |
| 3,946,187 | 3/1976 | MacMaster et al. | 219/10.55 E |
| 4,081,646 | 3/1978 | Goltsos | 219/10.55 E |
| 4,121,510 | 10/1978 | Frederick | 99/425 |
| 4,190,757 | 2/1980 | Turpin et al. | 219/10.55 E |
| 4,196,331 | 4/1980 | Leveckis | 219/10.55 E |
| 4,214,515 | 7/1980 | Kubiatowicz | 99/400 |
| 4,230,924 | 10/1980 | Brastad et al. | 219/10.55 E |
| 4,267,420 | 5/1981 | Brastad | 219/10.55 E |
| 4,272,663 | 6/1981 | Green | 219/10.55 E |
| 4,319,680 | 3/1982 | Heimstra | 206/45.14 |
| 4,398,077 | 8/1983 | Freedman et al. | 219/10.55 E |
| 4,470,538 | 9/1984 | Heathcock | 229/23 R |
| 4,474,324 | 10/1984 | Forbes | 229/23 BT |
| 4,555,605 | 11/1985 | Brown et al. | 219/10.55 E |
| 4,589,553 | 5/1986 | Fearero | 206/525 |
| 4,590,349 | 5/1986 | Brown | 219/10.55 E |
| 4,594,492 | 6/1986 | Maroszek | 219/10.55 E |
| 4,612,431 | 9/1986 | Brown et al. | 219/10.55 E |
| 4,626.641 | 12/1986 | Brown | 219/10.55 E |
| 4,641,005 | 2/1987 | Seiferth | 219/10.55 E |
| 4,642,434 | 2/1987 | Cox et al. | 219/10.55 E |
| 4,735,513 | 4/1988 | Watkins et al. | 383/116 |
| 4,777,053 | 10/1988 | Tobelmann et al. | 426/107 |
| 4,780,587 | 10/1988 | Brown | 219/10.55 E |
| 4,794,005 | 12/1988 | Swiontek | 426/107 |
| 4,820,893 | 4/1989 | Mode | 219/10.55 E |
| 4,870,233 | 9/1989 | McDonald et al. | 219/10.55 E |
| 4,876,427 | 10/1989 | Mode | 219/10.55 E |
| 4,894,247 | 1/1990 | Fong | 426/107 |
| 4,933,526 | 6/1990 | Fisher et al. | 219/10.55 E |
| 4,935,592 | 6/1990 | Oppenheimer | 219/10.55 E |
| 4,943,439 | 7/1990 | Andreas et al. | 426/107 |
| 5,039,833 | 8/1991 | Woods | 219/10.55 E |
| 5,049,710 | 9/1991 | Prosise et al. | 219/10.55 E |
| 5,075,526 | 12/1991 | Sklenak et al. | 219/10.55 E |
| 5,084,601 | 1/1992 | Andreas et al. | 219/10.55 E |
| 5,175,404 | 12/1992 | Andreas et al. | 219/10.55 E |

FOREIGN PATENT DOCUMENTS 62-158929 7/1987 Japan .

*Primary Examiner*—Philip H. Leung
*Attorney, Agent, or Firm*—James V. Harmon

[57] ABSTRACT

A microwave food heating package for food pieces such as french fried potatoes or fish sticks is described. The package includes one or more susceptor sheets folded in alternately opposite directions to provide accordion folds therein which define V-shaped pockets that serve as heating chambers for individual pieces of food. The susceptor sheet is formed from a microwave energy-absorbing material adapted to heat, brown or crispen the surfaces of the food sticks. The heating chambers preferably enclose the food sticks on all major surfaces and can be made by layering, i.e. stacking, segments of the accordion-pleated susceptor sheet material one above another to form individual heating chambers for the food pieces to crispen, toast or brown their surfaces during heating.

23 Claims, 4 Drawing Sheets

MICROWAVE FOOD HEATING PACKAGE WITH ACCORDION PLEATS

FIELD OF THE INVENTION

The present invention relates to a microwave food heating package and more particularly to a food heating package containing a folded microwave interactive susceptor sheet that enhances the heating of food in a microwave oven.

BACKGROUND OF THE INVENTION

A number of devices have been developed to enhance the taste and aesthetic quality of food cooked in microwave ovens either by ensuring uniform heat circulation (U.S. Pat. No. 4,121,510), by browning and searing foods through creating and control of electrical fields using conductive metals (U.S. Pat. No. 3,946,187) or by converting microwave energy, by way of a resistive film, to heat energy which is transferred to the food surface by way of a corrugated metal sheet (U.S. Pat. No. 4,398,077). These devices are all cooking utensils. By contrast, the invention is concerned with disposable packaging, typically formed from paper and plastic film.

Laminated sheets known as susceptors have been previously proposed for heating foods with microwave energy by absorbing a portion of the microwave energy and transferring it by conduction to a food product. In some cases sheet material of this kind from which the susceptor is formed is stiff, brittle, subject to breakage, and not adapted for use in lightweight packaging products which should be disposable and low in cost. In other cases the laminated susceptors, while interacting with the microwave energy present in an oven, do not adequately heat the food product. Still other laminates can heat only one side of the food product. So, for example, if the food product is rectangular in shape, two or more sides remain unheated.

The application of heat to at least two sides of each piece of food, and most preferably to all sides, is highly beneficial because it has been found that when a food piece such as a french fried potato is placed in an ordinary paperboard carton and heated in a microwave oven, the potato pieces become soggy. This occurs even if an effort is made to allow steam to vent from openings at the top of the package. As a result, attempts have been made to develop susceptors for lining food cartons to augment the heat provided by direct microwave interaction with the food For example, U.S. Pat. Nos. 4,612,431 and 4,735,513 describe laminates comprised of polyester to which thin, semiconductive layers of metal have been applied. These laminates are bonded to a wall of the package for absorbing microwave energy and transferring the energy to the food product as heat. Tests have shown, however, that these laminates and the resulting packages are not effective in crisping, browning or toasting the surface of foods such as french fried potatoes where there are numerous pieces of food present in the package. Thus, after heating, the products are perceived to be moist, limp and soggy.

Other attempts have been made to deal with the problem of crisping the surface of a food product. For example, U.S. Pat. Nos. 4,267,420 and 4,230,924 provide a lightweight flexible wrapper formed from a laminate composed of a flexible sheet material that interacts with microwave energy. One major shortcoming is that food sticks have to be individually wrapped and later unwrapped one-by-one by the consumer. Another problems results from the fact that portions of the sheet material, when unsupported, can shrivel, shrink, split and crack, particularly in areas where it is not in contact with the food.

U.S. Pat. Nos. 4,935,592 and 5,084,601 address the objectives of 1) providing a microwave interactive laminate or susceptor as a sheet of material that will crisp, toast or brown several surfaces of a stick-shaped food product such as french fried potatoes, fish sticks and the like so that after heating it is perceived to be crisp and appetizing to the consumer; and 2) configuring this microwave interactive sheet material within a package to furnish a plurality of compartments that will each enclose individual food pieces, and particularly food in stick form such as french fried potatoes or the like, snugly enough to contact or almost contact and heat the food pieces on all major sides but yet hold the food pieces sufficiently loose to allow the food pieces to be easily removed.

The package described in U.S. Pat. No. 5,084,601, while very good, is somewhat complicated and expensive to manufacture and has been perceived by consumers to contain too much packaging material. Therefore, one major objective of the present invention is to provide a simpler and lower cost package that uses less material, is lighter in weight to serve as a disposable package suitable for heating individual servings of stick or log shaped foods such as french fried potatoes, fish sticks, egg rolls, bread sticks or waffle sticks in a microwave oven and for browing, crisping or toasting the surface of each food piece.

SUMMARY OF THE INVENTION

The present invention provides a microwave food heating package containing at least one microwave interactive susceptor which is folded or pleated in an accordion-style fashion and is preferably configured in layered segments to provide a plurality of self-supporting, parallel, elongated typically rectangularly shaped chambers that are inclined, i.e., tipped on an edge, with respect to the plane or planes in which they are aligned so as to appear generally diamond-shaped. Each chamber encloses an individual piece of food product which preferably contacts or almost contacts the chamber on four sides to enhance heating in a microwave oven. In one form of the invention, the assembled susceptor segments and food are enclosed in a carton and/or overwrap. In another form, the assembled susceptor segments and food are held in place by a surrounding paper band. In a third form, the susceptor assembly and food is contained in a paper or plastic film pouch.

The folded susceptor segments are preferably arranged in layers; e.g., by being folded over one another so that the segments are stacked in vertically spaced apart parallel planes. Alternatively, the susceptor segments can be discontinuous, separate susceptor sheets, arranged one above another; i.e., stacked as separate sheets in vertically spaced apart parallel planes.

Each susceptor segment can be made from any suitable known microwave interactive material such as a metal or carbon-containing layer bonded to a supporting sheet. One preferred susceptor is a laminate formed of a metallized polyester film adhesively bonded between two paper sheets. For example, the metallized polyester sheet or a sheet containing other microwave interactive material which becomes hot in a microwave oven, such as a metal, metal oxide, carbon or the like, can be bonded between a sheet of greaseproof paper and a sheet of kraft paper. This laminate is folded into accordion-style or zigzag pleats to provide a susceptor segment having a plurality of laterally spaced apart, parallel V-shaped pockets for the food pieces. When the segments are placed next to one another in parallel planes, they form parallel chambers for loosely holding the food pieces so that the food pieces can be easily removed from the chambers by sliding them out of one end when they are to be eaten. Each chamber conforms generally to the shape of the food product, with the distance between the folds of the accordion pleats determined by the dimensions of the food pieces. When the food product has a rectangular cross-section, each pocket encloses two adjacent sides of the food piece. An adjacent folded segment of the susceptor material encloses the remaining two adjacent sides of the same food piece.

In a typical application, the invention includes a stack of susceptor segments placed on top of one another with food pieces between them to provide heating surfaces on all major sides of each food piece. The invention can be embodied in a throw-away carton consisting of an inner sleeve and an outer tray. The sleeve portion contains the heating segments so that after heating, when the sleeve portion of the carton is removed from the tray, the food products can be shaken out into the tray portion of the package which then functions as a serving tray. In another application, the stack of susceptor segments are held in alignment by a paper band and overwrapped with paper or with a film such as cellophane. The paper strip has a fin seal which acts as a tab that can be used to pick up the susceptor sheets containing the food after heating. In a third alternative application, the susceptor segments are contained in a paper or plastic film pouch; after heating, the pouch is torn open and the food pieces shaken out.

The invention will now be described by way of example with reference to the accompany figures which illustrate only a few of the various ways in which the present invention can be practiced within the scope of the appended claims.

THE FIGURES

DESCRIPTION OF THE PREFERRED EMBODIMENTS

Figure 1:
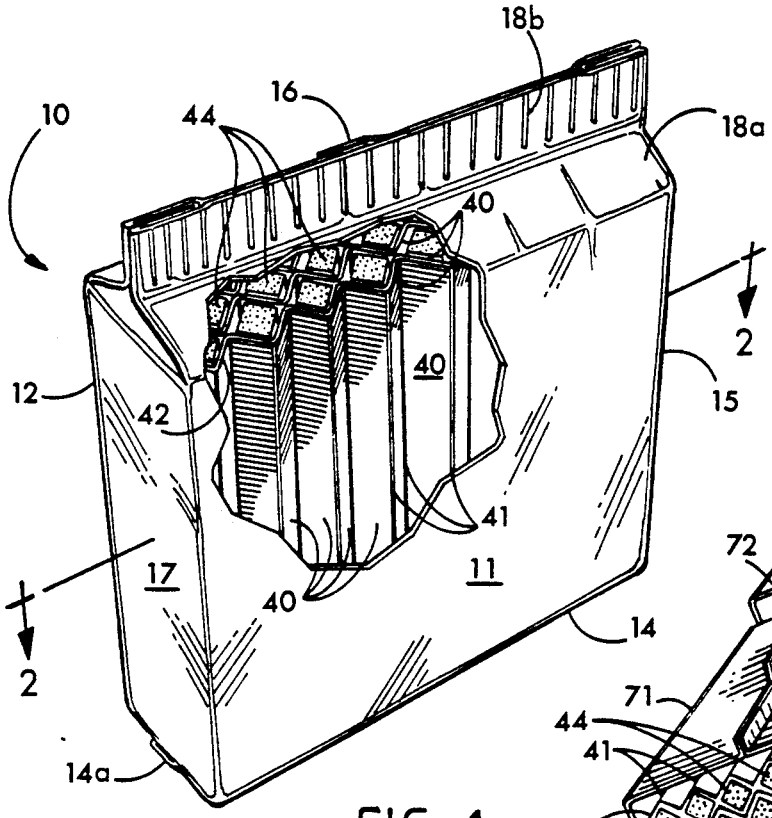
FIG. 1 is a perspective view partially broken away of a microwave food heating package of the invention.
Figure 2:
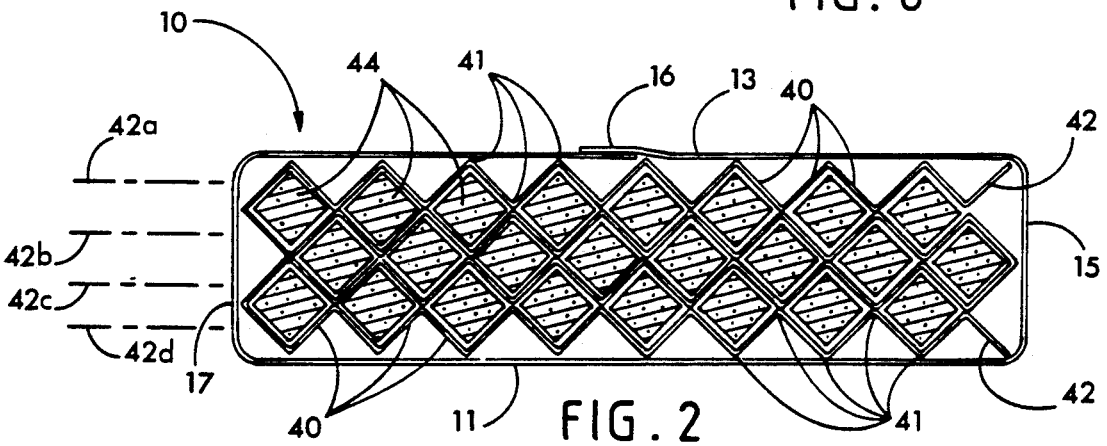
FIG. 2 is a cross-sectional view taken on line 2—2 of FIG. 1.

Refer to FIGS. 1 and 2 which show one form of the invention. Shown in the figures is a package 10 comprising a paper pouch 12 including broad front and rear walls 11 and 13 and narrow side walls 15 and 17. The top is pinched together at 18*a* and is closed transversely by means of an adhesively bonded seal 18*b*. The bottom wall 14 of the pouch 12 is sealed by means of a bottom adhesive seal 14*a* and the side edges by an upright seal 16. Inside the pouch 12 is a susceptor 42 formed from sheet material, e.g., a laminate of paper and plastic film having numerous parallel longitudinally extending, alternately oppositely directed folds 41, e.g., 90° folds, to define on either side of themselves adjacent pairs of panels 40 that enclose two adjacent surfaces of food pieces 44 such as french fried potato pieces. In this form, the parallel susceptor sheets 42 are divided by being folded so as to be stacked in parallel horizontally spaced apart aligned planes 42*a*–42*d* to define food-containing chambers which hold the potato pieces 44. The food and susceptor are thus shipped in the pouch 12 which can be formed from any suitable microwave transparent paper or plastic film known to those skilled in the art, such as 30-pound bleached kraft, or from cellophane. Labels (not shown) are printed on the pouch 12. After heating, the pouch is opened be tearing apart the seal 18*b*. The hot, crispened food pieces 44 can then be shaken out onto a plate.

FIG. 2 shows clearly how a single sheet of susceptor material 42 is folded three times so as to provide four segments lying in planes 42*a*–42*d* to form food-containing chambers.

It should be noted that in all forms of the invention, the number of folds or pleats 41 per segment, and therefore the number of chambers created by each pair of segments, can be varied. The number of segments can also be varied as needed. In some cases, one segment can be used, but at least two are usually preferred.

Figure 8:
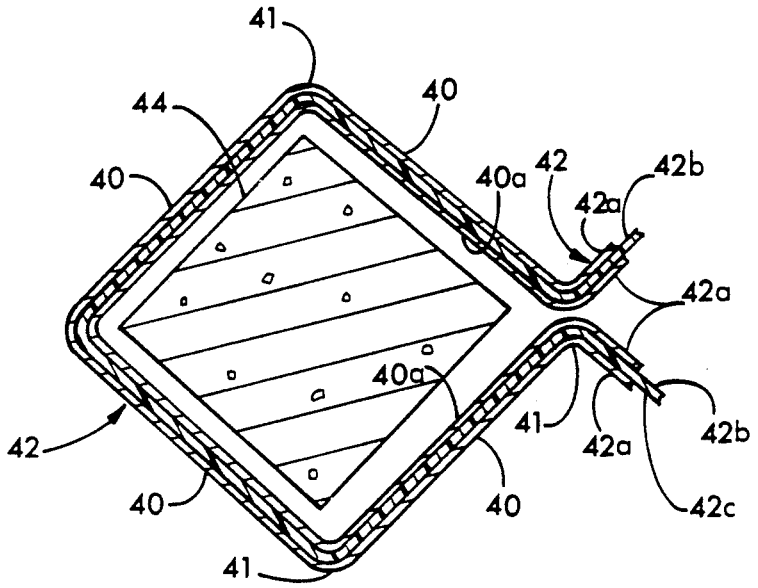
FIG. 8 is a microscopic cross-sectional view of the susceptor of FIG. 4 taken on line 8—8 of FIG. 4.
Figure 7:
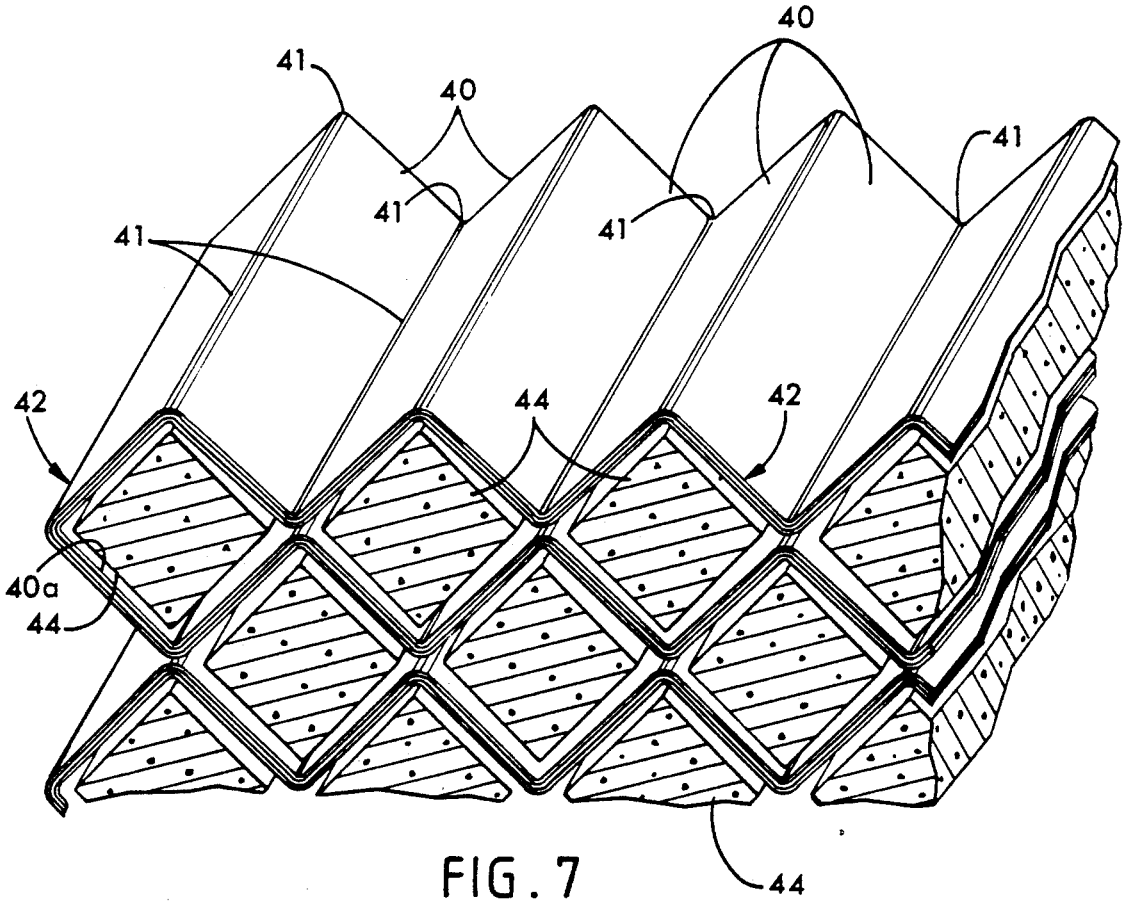
FIG. 7 is an enlarged, semi -diagrammatic perspective view showing one form of susceptor folded to provide continuous, i.e. connected, segments layered one above another in accordance with one form of the invention.

In FIGS. 7 and 8 is shown a susceptor sheet 42 which in this case is a laminate of three separate sheets bonded together with adhesive and including two sheets of paper 42*a*, both of which face the food 44. Between sheets 42*a* is adhesively bonded a sheet of flexible plastic 42*b* such as polyester film that serves as a backing for a microwave interactive coating, e.g., a semiconductive metallic coating 42*c*, typically aluminum deposited by vacuum metallization thin enough to transmit about 40% to 60% of incident light. The metal is deposited as a coating upon the plastic base sheet 42*b* such as a 2 mil polyester film. The metal coating is semiconductive so that it will interact with the microwave energy in a microwave oven to absorb a portion of the microwave energy, convert it to heat and in that way brown, toast or crisp the surface of the food pieces 44. Other known microwave interactive coatings or substances that will become hot in a microwave oven can be used in place of the metal coating, if desired.

The susceptor 42 can be formed, for example, from sheets of 25-pound greaseproof and 25-pound kraft paper which make up the two outer sheets 42*a* of the laminate 42. Between them is adhesively bonded a 48-gauge polyester film 42*b* metallized with aluminum. The adhesive can be a polyvinyl acetate polymer or copolymer waterbased emulsion-type adhesive, e.g., Electromek adhesive by Electromek Company of Carlstadt, N.J., or Duracet adhesive by Franklin International, Inc. of Columbus, Ohio.

Figure 6:
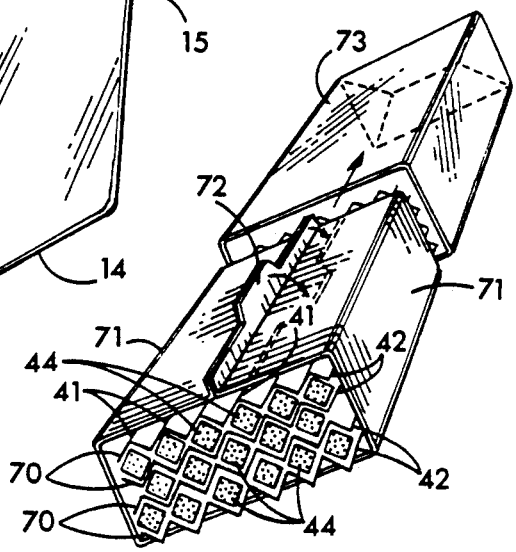
FIG. 6 is a perspective view of a form of the invention in which susceptor segments are held in alignment by a paper band overwrapped in cellophane.

The laminated susceptor 42 is folded into accordion pleats 41, i.e., the folds or pleats are alternately folded in opposite directions to form adjacent angularly related panels 40, in this case having an angle of 90° between them. Each fold or pleat 41 creates a V-shaped pocket 40*a* having flat panels 40 on each side of each fold 41. The susceptor 42 is preferably provided in layers made up of either disconnected or connected segments. The term "segments" herein means a piece or portion of a susceptor in a single plane. Four segments are shown, for example, in the parallel planes designated 42*a*–42*d*. These segments may be connected together as in FIGS. 1, 2, 7 and 8 or, in the alternative, the segments can be separate pieces of sheet material as shown in FIG. 6.

Figure 3:
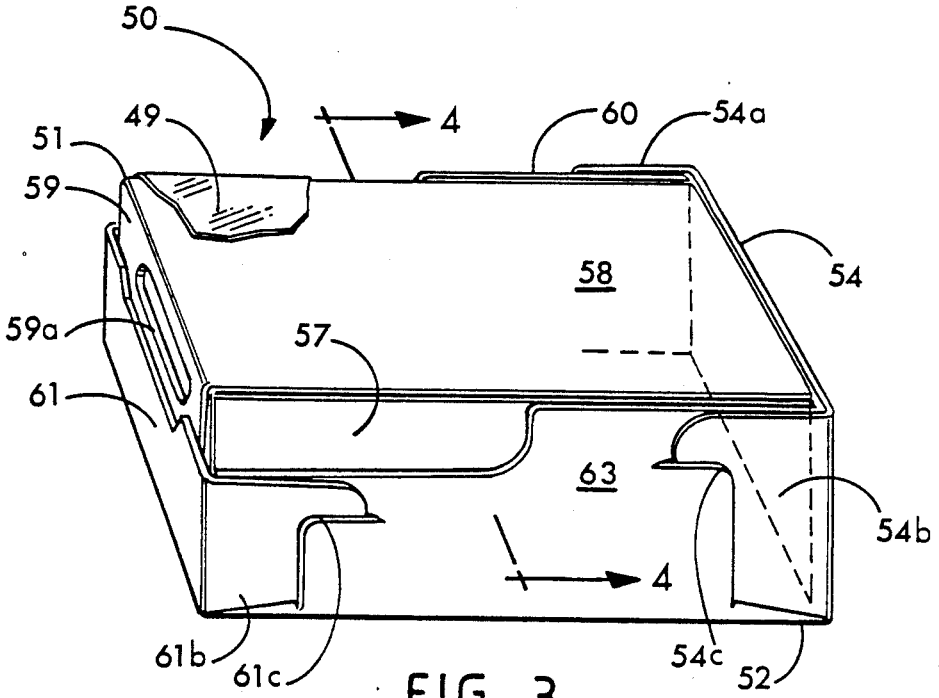
FIG. 3 is a perspective view according to another form of the invention.
Figure 4:
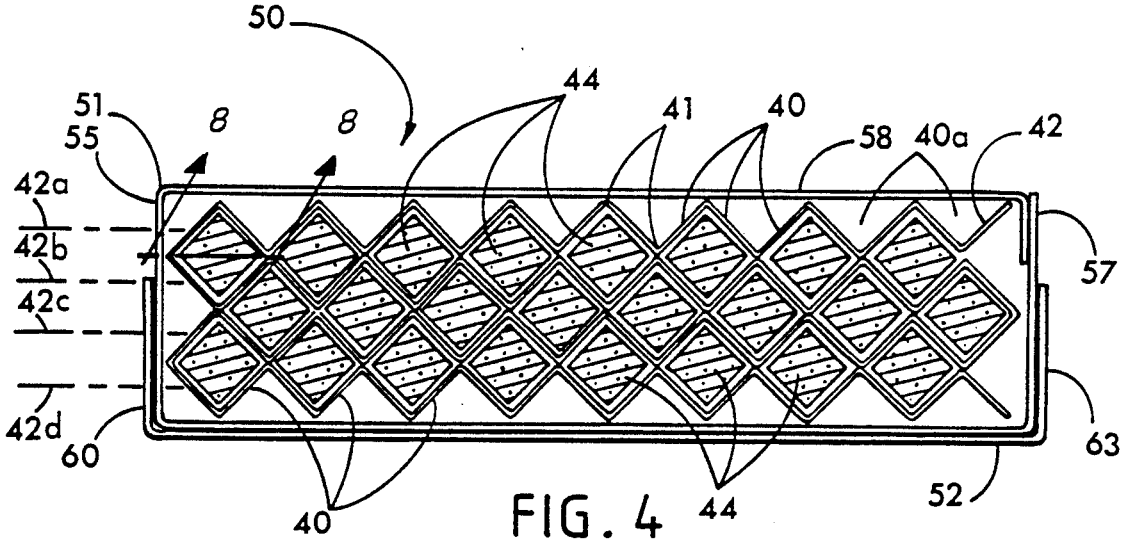
FIG. 4 is a cross-sectional view taken on line 4—4 of FIG. 3.
Figure 5:
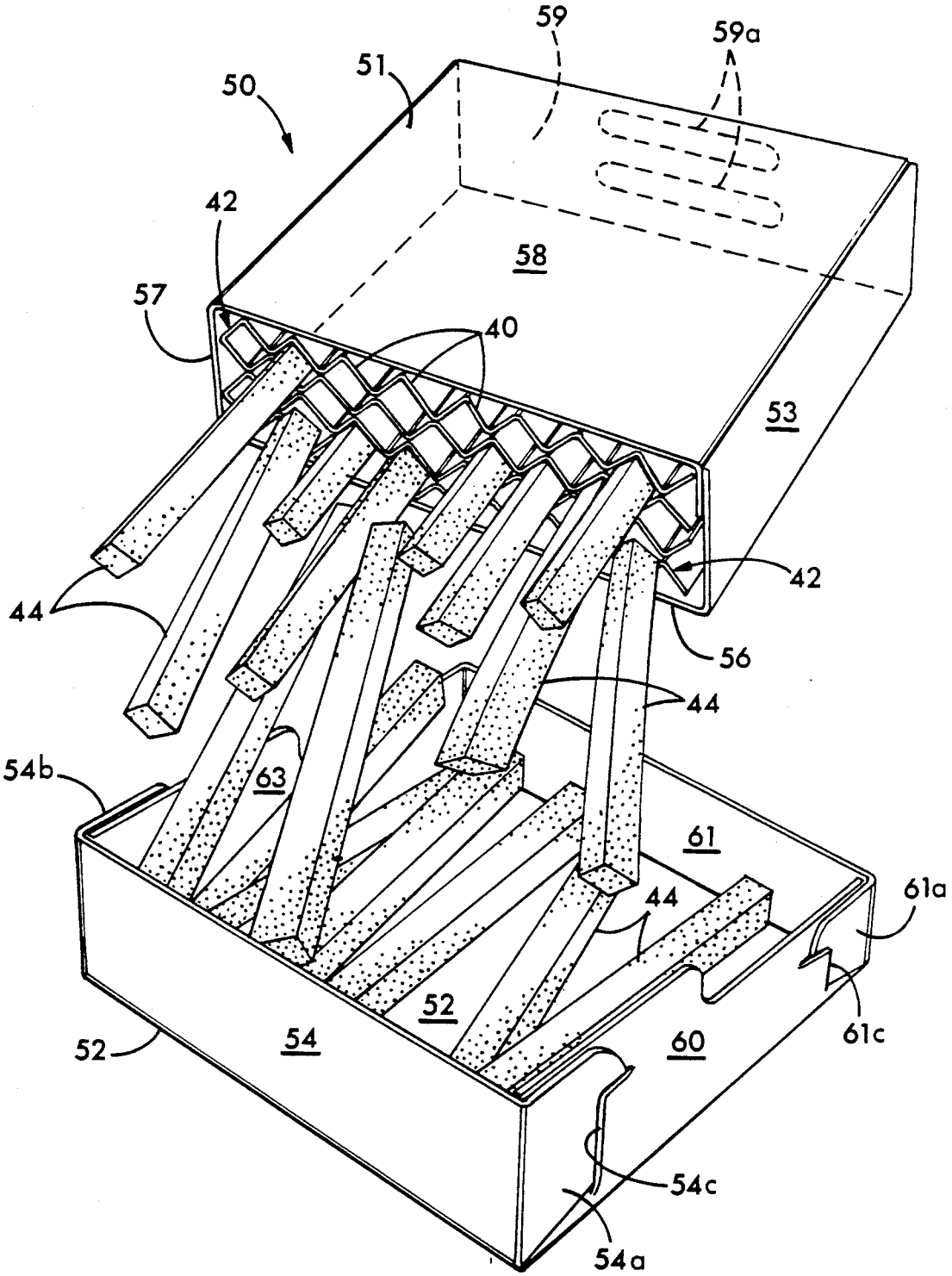
FIG. 5 is a perspective view of the carton of FIGS. 3 and 4, with food pieces being shaken into the tray portion of the carton for serving after heating.

Refer now to FIGS. 3, 4 and 5 which illustrate another embodiment of the invention. FIG. 3 shows a food carton 50 comprised of tray 52 and sleeve 51 portions. The sleeve 51 includes panels 53, 56, 57 and 58 and an end panel 59 having vent openings 59*a*. The tray 52 includes a broad bottom panel 52 and four short upright side panels 54, 60, 61 and 63. Both the sleeve 51 and the tray 52 of the carton 50 are made of a food grade paperboard and can be assembled using glue and/or locking tabs 54*a*, 54*b* and 61*b* engaged in slots 54*c*, 61*c*. The carton is overwrapped with protective barrier film 49 such as polypropylene or saran coated cellophane and sealed.

In FIG. 4, the sleeve portion 51 of the carton 50 contains the susceptor 42 which is provided with accordion folds 41 that form V-shaped pockets 40*a*. The susceptor 42 is configured into four connected segments which are folded over onto one another into layers. The layers are located in four parallel, vertically spaced apart planes 42*a*–42*d* such that the side panels 40 intersect these planes at 45° angles. The bottom fold 41 of each pocket contacts the top fold 41 of a pocket in the segment layer below it. When the susceptor 42 is configured in this way, it forms parallel, elongated, rectangular-shaped chambers having inclined walls. Each chamber is in this way formed from the side walls of an upper and lower V-shaped pocket 40*a*. The food pieces 44 conform generally to the shape and size of these chambers.

Refer now to FIG. 5 which illustrates the carton of FIGS. 3 and 4 after having been heated and opened. The hot, crispened food pieces 44 are shown being shaken out of the sleeve portion 51 that retains the susceptor 42 in the tray 52 which can then function as a serving dish.

Refer now to FIG. 6 which illustrates another form of the invention. In this case, individual separate segments 70 are stacked one above another but are not physically connected. In this way each pair of adjacent segments 70 form elongated rectangular parallel chambers between themselves in which individual food pieces 44, such as french fried potatoes, are located. When heated in a microwave oven, the susceptor 42 presents heat to all major surfaces of the food pieces 44, resulting in desirable heating, browning and crisping of the food pieces on all major surfaces. The distance between the accordion folds or pleats 41 depends on the size of the food pieces being heated. Disconnected accordion-pleated susceptor segments 70 are stacked in layers to form food-containing heating chambers. A narrow band of paper 71 is wrapped circumferentially around the stack of segments 70 to hold them in place and leave both ends of the chambers open. The ends of the paper band 71 are glued together in a fin seal 72 which provides a lifting tab that can serve as a handle for picking up hot food when it is to be removed from the oven. The food pieces, susceptor segments and paper band with tab are all contained in a paper or cellophane overwrap 73.

While the invention is suited for a variety of different kinds of food pieces such as french fried potatoes, fish sticks, waffle sticks, bread sticks, egg rolls, and the like, it is particularly well suited for use with fabricated food products such as cooked and mashed potato mass, i.e., potato dough which is molded to the rectangular shape shown, cut into pieces of the required length, fried in hot shortening, and then placed in the package. Although the forms of the invention described herein accommodate food pieces with a rectangular shaped cross-section, embodiments of the invention can be devised to accommodate food pieces with triangular, round or oval shaped cross-sections.

Many variations of the present invention within the scope of the appended claims will be apparent to those skilled in the art once the principles described above are understood.

What is claimed is:

1. A microwave heating package containing a susceptor for heating, browning or crisping food, comprising, an outer packaging enclosure formed from a material that is at least partially transparent to microwave energy, at least two susceptor segments, each comprising a laterally extending sheet of susceptor material for absorbing microwave energy to heat, brown and crisp the food, said susceptor segments are present in pairs wherein each segment is paired with a segment above or below it, each susceptor segment is folded to have a plurality of parallel, alternatively oppositely directed accordion folds so that each successive fold is bent in the opposite direction from the preceding and succeeding folds to form a plurality of adjacent panels that produce V-shaped pockets in each segment on opposite sides of each fold, a food piece is located in each pocket for being heated by the susceptor during heating in a microwave oven, said susceptor segments are arranged so that the segments of each pair are located on opposite sides of a piece of food, the arrangement being such that the pockets are aligned on opposite sides of the same food piece with a pocket in one segment of the pair enclosing the food piece on two adjacent upwardly facing sides and a pocket in the other segment of the pair enclosing the same food piece on its two opposite downwardly facing sides, said pockets defining chambers for the food pieces that are tipped on an edge with respect to a plane in which a row of said chambers are aligned, and the chambers in said row are staggered between the chambers of an adjacent row of chambers.

2. The microwave heating package of claim 1 wherein the food pieces are food sticks of rectangular cross-section, the folded susceptor segments are aligned to form polyagonal chambers bounded on opposite sides by the V-shaped pockets, and the rectangular chambers have sidewalls that are inclined with respect to the planes occupied by the susceptor segments.

3. The microwave heating package of claim 1 wherein the susceptor segments are made of a laminate comprising two paper sheets adhesively bonded to both sides of a base sheet of plastic film coated with a microwave interactive material.

4. The microwave heating package of claim 1 wherein the susceptor segments are physically connected and are different portions of a single susceptor sheet that is folded between adjacent segments and the folds are the boundaries of the segments.

5. A microwave heating package of claim 1, wherein the susceptor segments are physically disconnected such that each segment is a separate susceptor sheet.

6. A microwave heating package of claim 1, wherein the susceptor segments are enclosed in a carton having an upper sleeve portion containing the susceptor segments and a lower tray portion, and the carton is covered with a flexible overwrap.

7. The carton of claim 6 wherein after heating in a microwave oven, the sleeve portion can be lifted out of the tray portion and the food pieces shaken out from between the susceptor segments into the tray portion which can be used as a serving container.

8. The microwave heating package of claim 1 wherein the susceptor segments containing the food pieces are arranged in a stack, the stack is surrounded circumferentially by a paper band that is joined at the ends to form a fin seal that provides a tab which can be used as a handle to lift the food after heating.

9. The microwave heating package of claim 1 wherein the susceptor segments enclosing the food pieces are contained in a paper pouch that is sealed at its ends.

10. The microwave heating package of claim 9 wherein the pouch is made of paper or a transparent film.

11. The microwave heating package of claim 1 wherein the food pieces are formed from a cooked potato mash having the consistency of a formable dough, said dough is formed into strips, fried, and is located in said package between said susceptor segments.

12. The package of claim 11 wherein the food pieces are fabricated potato pieces composed of cooked, moldable moisture-containing potato mash, said mash is formed into self-supporting dough pieces, said pieces are cut to a selected length and fried in shortening, and the fried pieces are placed in said package between said segments of folded susceptor sheet material.

13. A package for heating individual elongated food pieces, the package including, a microwave interactive susceptor comprising a tray formed from a continuous sheet of microwave interactive sheet material, a plurality of alternately oppositely directed bends in the continuous sheet of microwave interactive sheet material to provide a zigzag configuration therein defining adjacent panels formed from the microwave interactive sheet material and the bends in the susceptor being aligned parallel to one another to divide the package into a plurality of side-by-side food-receiving chambers, each chamber being sized to hold at least one of the elongate food pieces that is to be heated by the microwave interactive sheet material, said chambers for the food pieces are tipped on an edge with respect to a plane of a row in which said chambers are aligned, at least two of the adjacent panels of each food-receiving chamber of the tray are oriented to face contiguous portions of the same one of said elongate food pieces positioned within the food-receiving chamber for heating said contiguous portions of the elongate food piece, the chambers in said row of chambers are staggered between the chambers of an adjacent row of chambers, whereby when exposed to microwave energy, said microwave interactive sheet material heats, crisps or toasts the elongate food pieces.

14. A package as claimed in claim 13 wherein the sheet material comprises paper or plastic film having a layer of a microwave interactive material applied to at least one surface thereof.

15. A package as claimed in claim 14 wherein the microwave interactive material comprises a semiconductive metallic coating that has been deposited by metallization.

16. A package as claimed in claim 13 wherein the sheet material comprises greaseproof paper.

17. A package as claimed in claim 13 wherein said package includes a plurality of said trays formed from segments of the sheet and said segments are stacked adjacent one another within the package to position the food pieces in layers.

18. A package as claimed in claim 13 wherein the chambers have open ends that can be selectively exposed so that the received elongate food pieces are able to slide out of the open ends of the chambers under the influence of gravity when the food pieces are to be served.

19. A package as claimed in claim 13 including a dish adapted to selectively receive and hold the food pieces after removal from the chambers.

20. A package as claimed in claim 13 including a package enclosure comprising a paper or paperboard carton.

21. A package as claimed in claim 20 wherein the paper or paperboard carton includes a removable portion that is telescopically mounted upon a second carton enclosure portion.

22. A package as claimed in claim 21 wherein the second carton portion is a sleeve that is open at one end and wherein there is a plurality of said susceptors stacked one above the other within the sleeve portion of the enclosure, each chamber having an open end exposed at the open end of the sleeve to facilitate the removal of the food pieces.

23. A package as claimed in claim 13 wherein a plurality of said trays are stacked one above the other within the package so that two adjacent trays positioned one above the other within the stack heat upper and lower portions of each food piece.

* * * * *